US007674149B2

(12) United States Patent
Chen

(10) Patent No.: US 7,674,149 B2
(45) Date of Patent: Mar. 9, 2010

(54) METHOD FOR FABRICATING FIELD EMITTERS BY USING LASER-INDUCED RE-CRYSTALLIZATION

(75) Inventor: Yu-Cheng Chen, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 1236 days.

(21) Appl. No.: 11/111,573

(22) Filed: Apr. 21, 2005

(65) Prior Publication Data

US 2006/0240734 A1 Oct. 26, 2006

(51) Int. Cl.
*H01J 9/00* (2006.01)
*H01J 9/02* (2006.01)

(52) U.S. Cl. ..... 445/50; 445/49; 445/51; 445/24; 438/20

(58) Field of Classification Search ..... 445/24, 445/25, 49–51; 438/20
See application file for complete search history.

(56) References Cited

U.S. PATENT DOCUMENTS 5,391,259 A * 2/1995 Cathey et al. ..... 445/50
6,451,631 B1 * 9/2002 Grigoropoulos et al. .... 438/149
6,608,326 B1 * 8/2003 Shinagawa et al. ..... 257/70

FOREIGN PATENT DOCUMENTS

JP 09 274849 10/1997
JP 09274849 A * 10/1997
WO WO 03015117 A1 * 2/2003

* cited by examiner

*Primary Examiner*—Mariceli Santiago
(74) *Attorney, Agent, or Firm*—Alston & Bird LLP

(57) ABSTRACT

Methods are provided for fabricating field emitters by using laser-induced re-crystallization. A substrate is first provided on which a silicon-containing layer is formed. A plurality of extrusive tips are thereafter formed to be extruded from the surface of the silicon-containing layer by using laser-induced re-crystallization. The methods of the laser-induced re-crystallization include a step of subjecting the overall or partial silicon-containing layer to an energy source, either unpatterned or patterned.

8 Claims, 6 Drawing Sheets

METHOD FOR FABRICATING FIELD EMITTERS BY USING LASER-INDUCED RE-CRYSTALLIZATION

BACKGROUND OF THE INVENTION

The present invention generally relates to semiconductor manufacturing process and, more particularly, relates to a method for manufacturing field emitters by means of laser-induced re-crystallization.

In recent years, field emitters have been developed and widely used in electronic applications such as field emission displays (FEDs), backlight units, field emission transistors and field emission diodes. When subjected to a suitable electrical field, electrons are emitted from the field emitters and impinge on phosphors coated on the back of a transparent cover plate to produce an image or light. Such a cathodoluminescent process is known as one of the most efficient methods for generating light. Typically, the field emitters can be implemented by means of an array of micro-tips or carbon nano-tubes.

In the early development for field emitters, a so-called spindt tip process for forming metal micro-tips was utilized. In such a process, a silicon wafer is first oxidized to produce a thick silicon oxide layer and then a metallic gate layer is deposited on top of the oxide. The metallic gate layer is then patterned to form gate openings, while subsequent etching of the silicon oxide underneath the openings undercuts the gate and creates a well. A sacrificial material layer such as nickel is deposited to prevent deposition of nickel into the emitter well. Molybdenum is then deposited at normal incidence such that a cone with a sharp point grows inside the cavity until the opening closes thereabove. An emitter cone is left when the sacrificial layer of nickel is removed.

In an alternate design, silicon micro-tip emitters can be formed by first conducting thermal oxidation on silicon and then followed by patterning the oxide and selectively etching to form silicon micro-tips.

However, a major disadvantage of the micro-tip emitter is the complicated processing steps that must be used to fabricate the device. For instance, the formation of the various layers in the device, and specifically the formation of the micro-tips, requires a thin film deposition technique followed by a photolithographic and etching process. As a result, numerous process steps must be performed in order to define and fabricate the various structural features. The film deposition processes, photolithographic processes and etching processes involved greatly increase the manufacturing cost thereof.

BRIEF SUMMARY OF THE INVENTION

It is therefore an object of the present invention to provide a method for fabricating filed emitters by using a laser-induced re-crystallization technique that does not have the drawbacks or shortcomings of the conventional method.

It is another object of the present invention to provide a method for fabricating field emitters by using a laser-induced crystallization technique that is simple and cost-effective.

The present invention is directed to a method for fabricating field emitters that obviates the problems resulting from the limitations and disadvantages of the prior art.

In accordance with an embodiment of the present invention, there is provided a method for fabricating field emitters, including the steps of (a) providing a substrate; (b) forming a silicon-containing layer over the substrate; and (c) forming a plurality of extrusive tips extruded from the surface of the silicon-containing layer by subjecting the silicon-containing layer to an energy source.

Also in accordance with the present invention, there is provided a method for fabricating field emitters, including the steps of: (a) providing a substrate; (b) forming a silicon-containing layer over the substrate; and (c) forming a plurality of extrusive tips extruded from the surface of the silicon-containing layer by subjecting the silicon-containing layer to a patterned energy source.

Further in accordance with the present invention, there is provided a method for fabricating field emitters, including the steps of: (a) providing a substrate; (b) forming a first conductive layer over the substrate; (c) forming a silicon-containing layer over the first conductive layer; (d) sequentially forming an insulative layer and a second conductive layer over the silicon-containing layer; (e) patterning the second conductive layer and the insulative layer to expose the silicon-containing layer; and (f) forming a plurality of extrusive tips extruded from the surface of the exposed silicon-containing layer by subjecting the exposed silicon-containing layer to an energy source.

Still further in accordance with the present invention, there is provided a method for fabricating field emitters, including the steps of: (a) providing a substrate; (b) forming a silicon-containing layer over the substrate; (c) patterning the silicon-containing layer to form a plurality of silicon-containing islands; and (d) forming a plurality of extrusive tips extruded from the surface of the silicon-containing islands by subjecting the silicon-containing islands to an energy source.

Additional features and advantages of the present invention will be set forth in part in the description which follows, and in part will be obvious from the description, or may be learned by practice of the invention. The features and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the present invention and together with the description, serve to explain the principles of the invention.

BRIEF DESCRIPTION OF THE SEVERAL VIEWS OF THE DRAWINGS

Reference will now be made in detail to the present embodiment of the invention, an example of which is illustrated in the accompanying drawings. Wherever possible, the same or analogous reference numbers are used throughout the drawings to refer to the same or like parts.

In the drawings.

DETAILED DESCRIPTION OF THE INVENTION

Figure 1A:
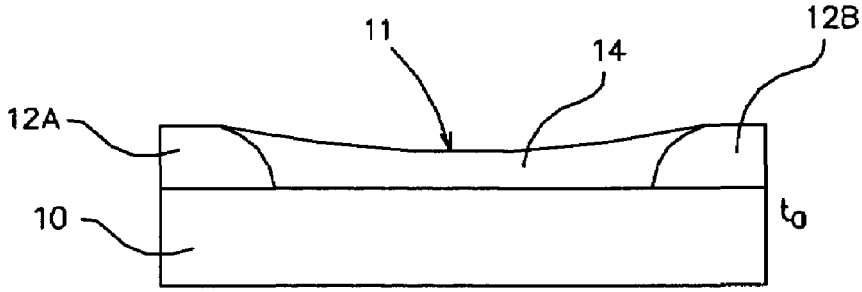
FIGS. 1A thru 1D are schematic diagrams showing the formation of extrusive tips after a silicon layer is subjected to a laser beam and then crystallized.
Figure 1B:
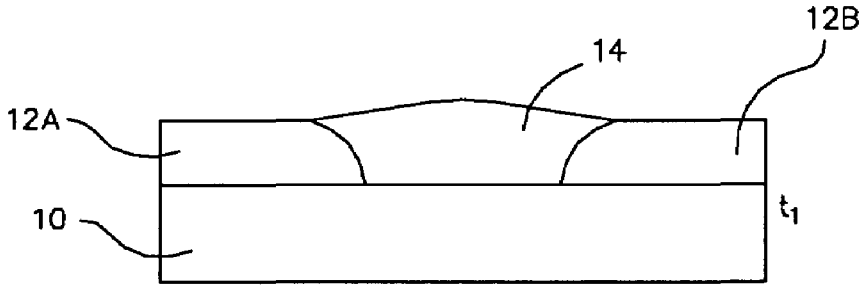
Figure 1C:
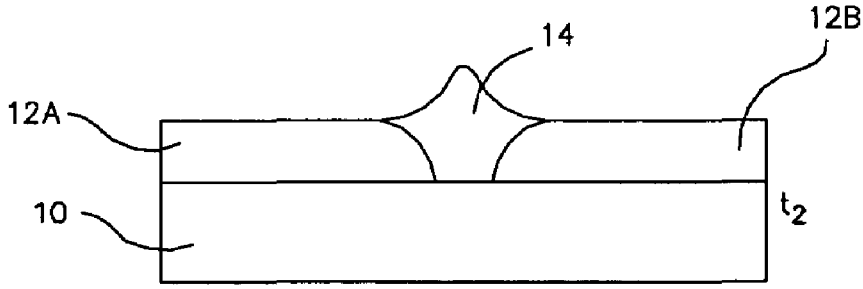
Figure 1D:
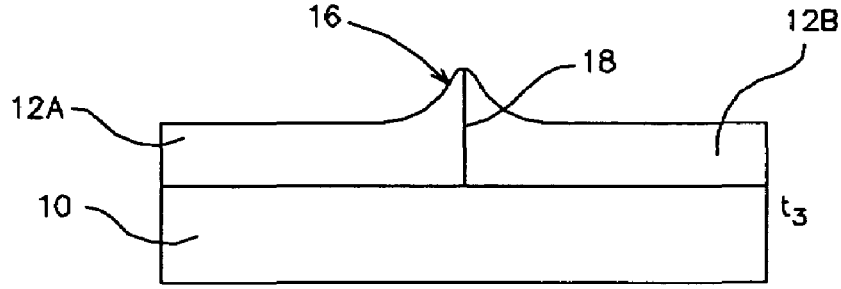

Referring to FIGS. 1A thru 1D, schematic diagrams for explaining the formation of extrusive tips after a silicon-containing layer is subjected to laser beam and then crystallized are illustrated. In FIG. 1A, a silicon-containing layer 11 is deposited on or over a substrate 10, which can be one of several types of substrates. For example, substrate 10 can be one of a silicon substrate, glass substrate, quartz substrate, sapphire substrate, plastic substrate, and the like. Preferably, the silicon-containing layer 11 is an amorphous silicon layer or a polycrystalline silicon layer. The silicon-containing layer 11 can be doped with n-type or p-type impurities. Preferably, the silicon-containing layer 11 has a thickness in the range between about 200 Å and about 8000 Å. The silicon-containing layer 11 is then exposed to an energy source (not shown in FIGS. 1A thru 1D) and melted to become a liquid 14. Preferably, the energy source can be a laser beam, such as Nd:YAG laser, carbon dioxide ($CO_2$) laser, argon (Ar) laser, excimer laser or the like. At time $t_0$ in FIG. 1A, the liquid 14 cools down such that some portions 12A and 12B nucleate to become crystallized. The solid portions 12A and 12B are generally known as grains to those ordinarily skilled in the art. The grains 12A and 12B gradually extend from liquid-solid interface (see time $t_1$ in FIG. 1B), and the liquid portion 14 gradually extrudes from the surface (see time $t_2$ in FIG. 1C) because the density of liquid silicon ($D_{LS}$) is greater than that of solid silicon ($D_{SS}$). Note that the gap between solid portions 12A and 12B becomes smaller as time progresses. At time $t_3$ in FIG. 1D, the gap between the solid portions 12A and 12B is closed to form a grain boundary 18. At time $t_3$, the liquid 14 is vanished. However, an extrusive tip 16 is formed in the vicinity of grain boundary 18 and extruded from the surface of the silicon-containing layer 11.

Figure 2:
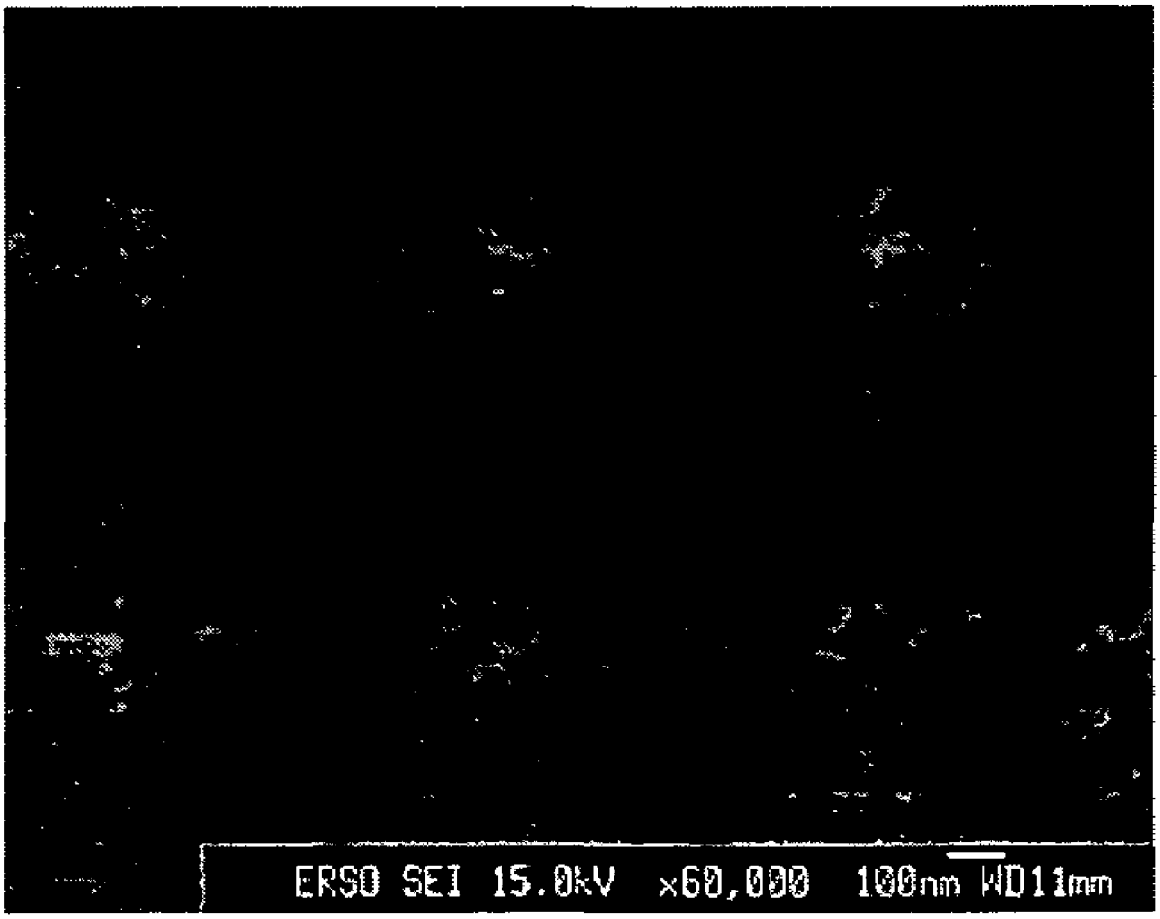
FIG. 2 is an SEM diagram of extrusive tips formed by laser-induced crystallization in accordance with the present invention.

Referring to FIG. 2, a Scanning Electron Microscope (SEM) diagram of extrusive tips formed by laser-induced crystallization in accordance with the present invention is illustrated. FIG. 2 shows that the silicon-containing layer 11 of FIG. 1D, after being subjected to the energy source, produces many extrusive tips 16 which can serve as field emitters in the application of field emission displays, backlight units, field emission transistors or field emission diodes.

Figure 3A:
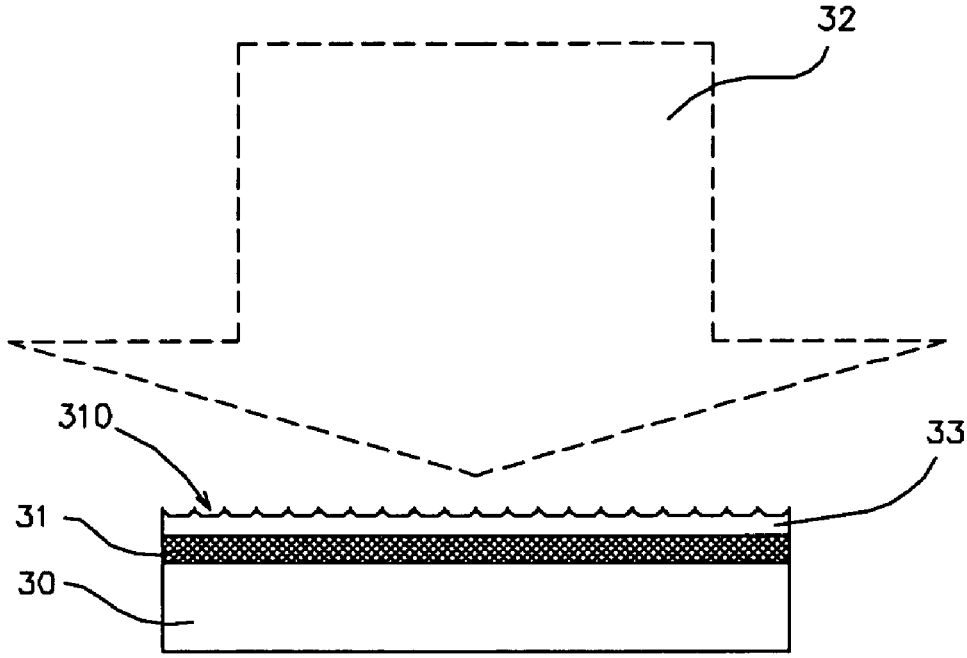
FIGS. 3A and 3B are schematic diagrams showing processing steps for fabricating a triode device according to one preferred embodiment of the present invention in cross-sectional views.
Figure 3B:
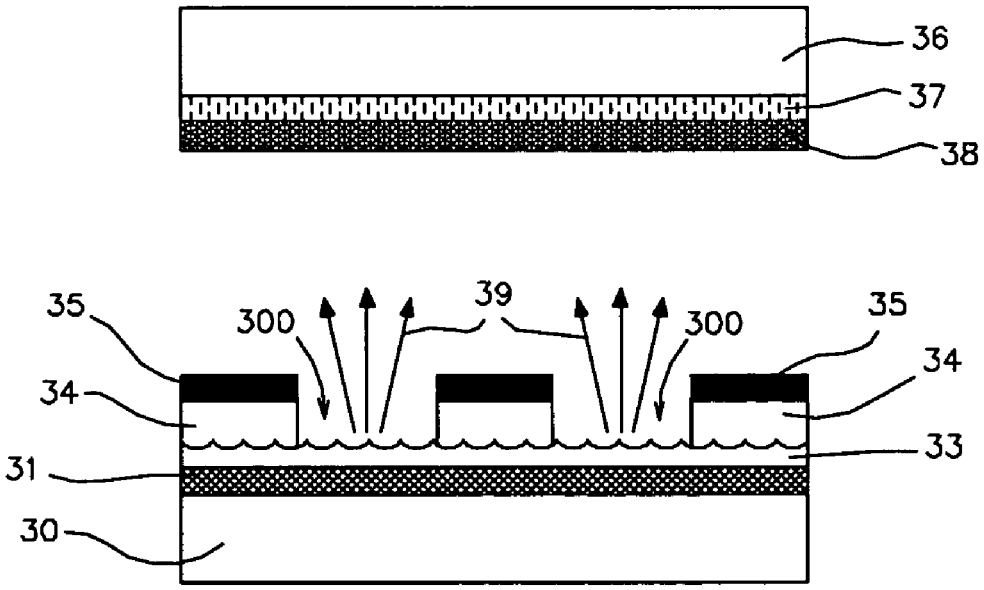

Referring to FIGS. 3A and 3B, processing steps for fabricating a triode device according to one preferred embodiment of the present invention in cross-sectional views are illustrated schematically. As shown in FIG. 3A, a cathode electrode layer 31 and a silicon-containing layer 33 are sequentially deposited on or over a bottom substrate 30. As noted above, the bottom substrate 30 can be a silicon substrate, glass substrate, quartz substrate, sapphire substrate, plastic substrate or the like. Preferably, the silicon-containing layer 33 is an amorphous silicon layer or a polycrystalline silicon layer, which is doped with n-type or p-type impurities and has a thickness ranging between about 200 Å and about 8000 Å. The whole of the silicon-containing layer 33 is then exposed to an energy source 32 and melted to become liquid. Preferably, the energy source can be a laser beam, such as Nd:YAG laser, carbon dioxide ($CO_2$) laser, argon (Ar) laser, excimer laser or the like. After it is melted and crystallized, the silicon-containing layer 33 has a plurality of extrusive tips 310 extruded from the surface of the silicon-containing layer 33.

Next, an insulative layer 34 and a gate electrode layer 35 are sequentially deposited on or over the silicon-containing layer 33 as shown in FIG. 3B. The insulative layer 34 and the gate electrode layer 35 are etched and patterned to form openings 300 exposing portions of the silicon-containing layer 33 by etch and photolithography processes. Moreover, an anode electrode layer 37 and a phosphor layer 38 are sequentially formed to overlay a top substrate 36 that can be a silicon substrate, glass substrate, quartz substrate, sapphire substrate, plastic substrate or the like. The top substrate 36 and the bottom substrate 30 are spaced apart by a predetermined distance and mounted together to form a complete triode device as shown in FIG. 3B. Such device of a triode structure utilizes the extrusive tips 310 of the silicon-containing layer 33 as field emitters. When a voltage difference is applied between a cathode electrode layer 31 and a gate electrode layer 35, electrons 39 are extracted from the cathode electrode layer 31 and accelerated toward the phosphor layer 38.

Figure 4A:
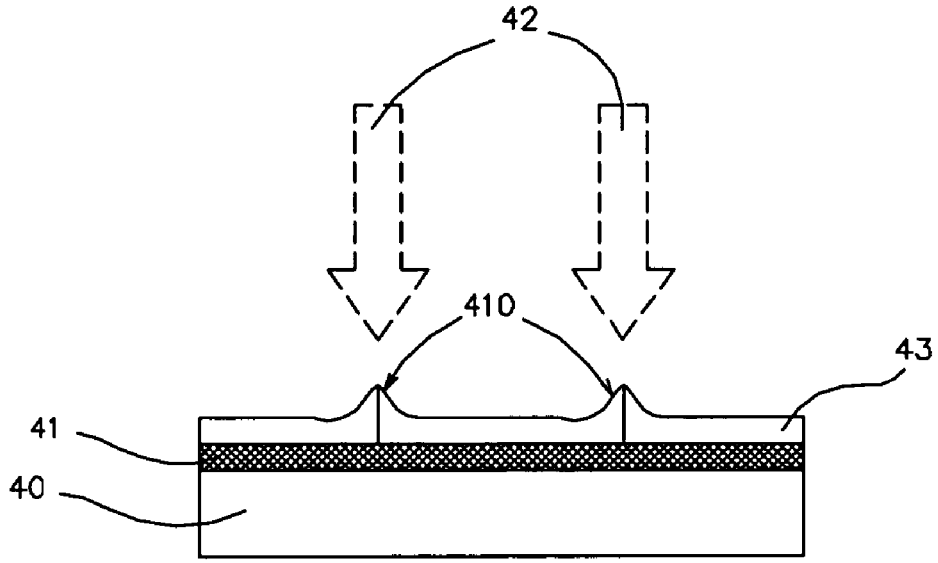
FIGS. 4A and 4B are schematic diagrams showing processing steps for fabricating a triode device according to another preferred embodiment of the present invention in cross-sectional views.
Figure 4B:
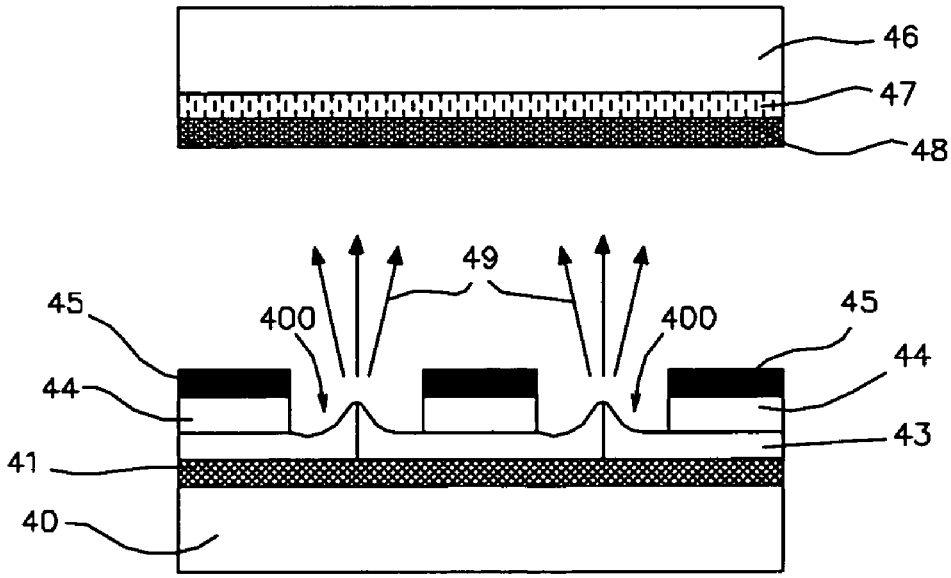

Referring to FIGS. 4A and 4B, processing steps for fabricating a triode device according to another preferred embodiment of the present invention in cross-sectional views are illustrated schematically. As shown in FIG. 4A, a cathode electrode layer 41 and a silicon-containing layer 43 are sequentially deposited on or over a bottom substrate 40, which can be a silicon substrate, glass substrate, quartz substrate, sapphire substrate, plastic substrate or the like. Preferably, the silicon-containing layer 43 is an amorphous silicon layer or a polycrystalline silicon layer, which is doped with n-type or p-type impurities. The silicon-containing layer 43 preferably has a thickness in the range between about 200 Å and about 8000 Å. In this embodiment, portions of the silicon-containing layer 43 are then exposed to a patterned energy source 42 and melted to become liquid at predetermined positions. Preferably, the energy source 42, such as a laser beam, passes through an optical grating or a raster so as to generate the patterned energy source 42. The energy source 42 can be one of Nd:YAG laser, carbon dioxide ($CO_2$) laser, argon (Ar) laser and excimer laser. After being melted and crystallized, the silicon-containing layer 43 has a plurality of extrusive tips 410 extruded from the surface of the silicon-containing layer 43.

Next, an insulative layer 44 and a gate electrode layer 45 are sequentially deposited on or over the silicon-containing layer 43 as shown in FIG. 4B. The insulative layer 44 and the gate electrode layer 45 are etched and patterned to form openings 400 exposing the extrusive tips 410 of the silicon-containing layer 43 by means of etch and photolithography processes. Moreover, an anode electrode layer 47 and a phosphor layer 48 are sequentially formed to overlay a top substrate 46 that can be a silicon substrate, glass substrate, quartz substrate, sapphire substrate, plastic substrate or the like. The top substrate 46 and the bottom substrate 40 are spaced apart by a predetermined distance and mounted together to form a complete triode device as shown in FIG. 4B. Such device of a triode structure utilizes the extrusive tips 410 of the silicon-containing layer 43 as field emitters. When a voltage difference is applied between a cathode electrode layer 41 and a gate electrode layer 45, electrons 49 are extracted from the cathode electrode layer 41 and accelerated toward the phosphor layer 48.

Figure 5A:
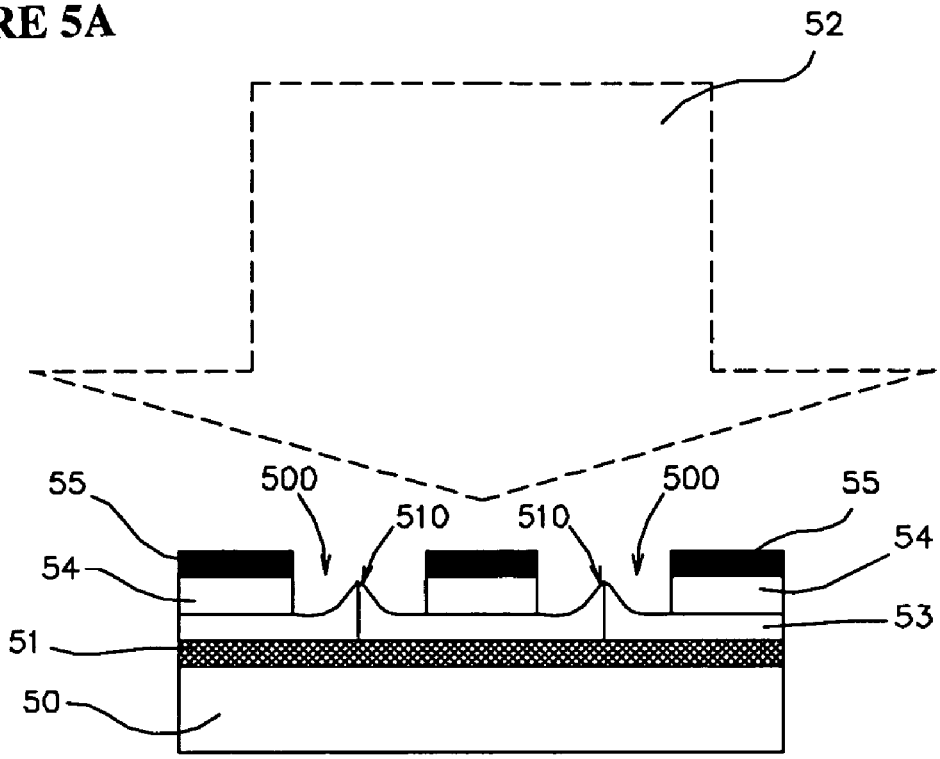
FIGS. 5A and 5B are schematic diagrams showing processing steps for fabricating a triode device according to further preferred embodiment of the present invention in cross-sectional views.
Figure 5B:
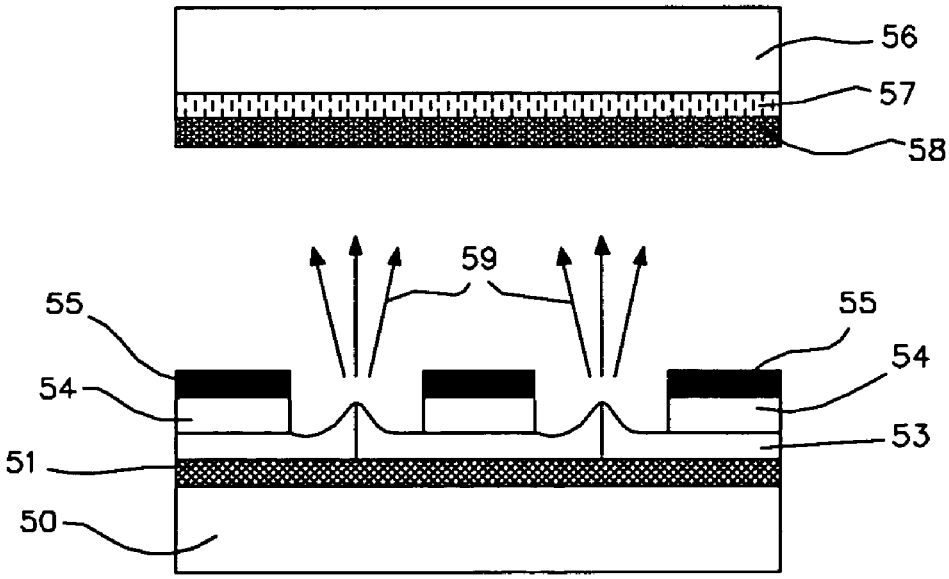

Referring to FIGS. 5A and 5B, processing steps for fabricating a triode device according to a further preferred embodiment of the present invention in cross-sectional views are illustrated schematically. As shown in FIG. 5A, a cathode electrode layer 51 and a silicon-containing layer 53 are sequentially deposited on or over a bottom substrate 50 that can be a silicon substrate, glass substrate, quartz substrate, sapphire substrate or the like. Preferably, the silicon-containing layer 53 is an amorphous silicon layer or a polycrystalline silicon layer, which is doped with n-type or p-type impurities and has a thickness in the range between about 200 Å and about 8000 Å. Next, an insulative layer 54 and a gate electrode layer 55 are sequentially deposited on or over the silicon-containing layer 53. The insulative layer 54 and the gate electrode layer 55 are etched and patterned to form openings 500 exposing portions of the silicon-containing layer 53 by means of etch and photolithography processes. In this embodiment, the exposed portions of the silicon-containing layer 53 are then subjected to an energy source 52 by the masking of the patterned gate electrode layer 55, and melted to become liquid at predetermined positions. Preferably, an energy source 52, such as Nd:YAG laser, carbon dioxide ($CO_2$) laser, argon (Ar) laser or excimer laser, passes through the openings 500 and melt the exposing portions of the silicon-containing layer 53. After being melted and crystallized, the silicon-containing layer 53 is has a plurality of extrusive tips 510 extruded from the surface of the silicon-containing layer 53.

Moreover, an anode electrode layer 57 and a phosphor layer 58 are sequentially formed to overlay a top substrate 56 that can be a silicon substrate, glass substrate, quartz substrate, sapphire substrate, plastic substrate or the like. The top substrate 56 and the bottom substrate 50 are spaced apart by a predetermined distance and mounted together to form a complete triode device as shown in FIG. 5B. Such device of a triode structure utilizes the extrusive tips 510 of the silicon-containing layer 53 as field emitters. When a voltage difference is applied between a cathode electrode layer 51 and a gate electrode layer 55, electrons 59 are extracted from the cathode electrode layer 51 and accelerated toward the phosphor layer 58.

Figure 6A:
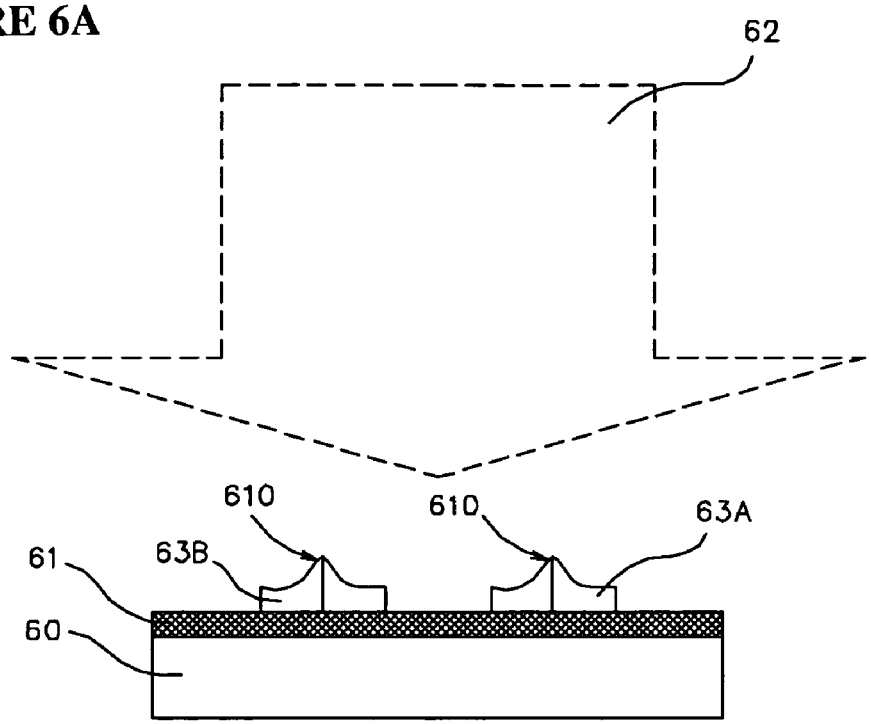
FIGS. 6A and 6B are schematic diagrams showing processing steps for fabricating a triode device according to further another preferred embodiment of the present invention in cross-sectional views.
Figure 6B:
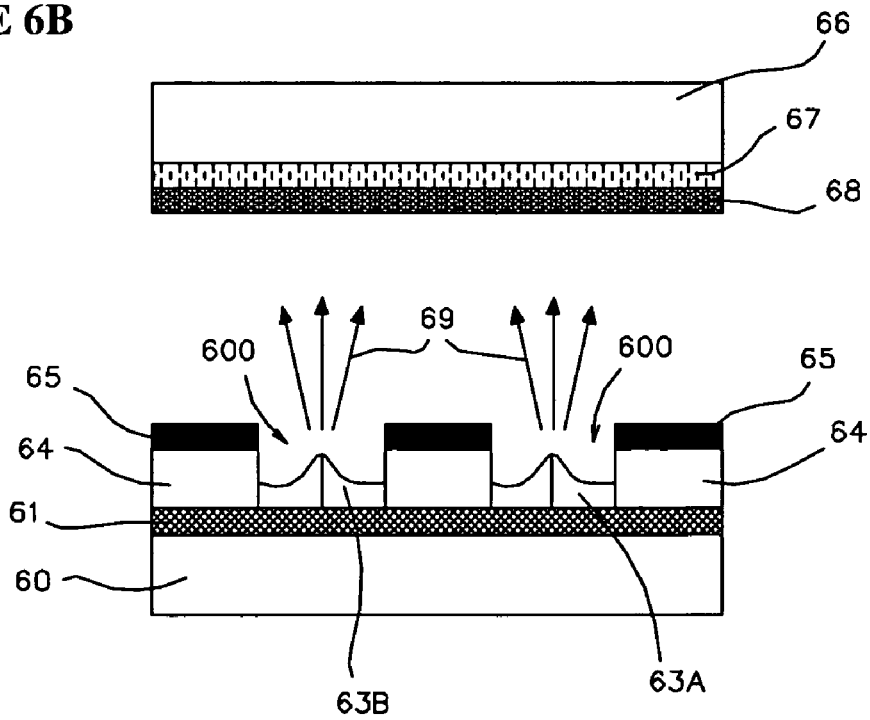

Referring to FIGS. 6A and 6B, processing steps for fabricating a triode device according to another preferred embodiment of the present invention in cross-sectional views are illustrated schematically. As shown in FIG. 6A, a cathode electrode layer 61 and a silicon-containing layer 63 are sequentially deposited on or over a bottom substrate 60 that can be a silicon substrate, glass substrate, quartz substrate, sapphire substrate, plastic substrate or the like. Preferably, the silicon-containing layer 63 is an amorphous silicon layer or a polycrystalline silicon layer, which is doped with n-type or p-type impurities and has a thickness in the range between about 200 Å and about 8000 Å. Next, the silicon-containing layer 63 is etched and patterned to form silicon-containing islands 63A and 63B by means of etch and photolithography processes. In this embodiment, the silicon-containing islands 63A and 63B are then subjected to an energy source 62 and melted to become liquid. Preferably, the energy source 62 is a laser beam, such as Nd:YAG laser, carbon dioxide ($CO_2$) laser, argon (Ar) laser or excimer laser. After being melted and crystallized, the silicon-containing layer 63 has a plurality of extrusive tips 610 extruded from the surface of the silicon-containing layer 63.

An insulative layer 64 and a gate electrode layer 65 are sequentially deposited on or over the silicon-containing layer 63 as shown in FIG. 6B. The insulative layer 64 and the gate electrode layer 65 are etched and patterned to form openings 600 exposing the extrusive tips 610 of the silicon-containing layer 63A and 63B by means of etch and photolithography processes. Moreover, an anode electrode layer 67 and a phosphor layer 68 are sequentially formed to overlay a top substrate 66 that can be a silicon substrate, glass substrate, quartz substrate, sapphire substrate, plastic substrate or the like. The top substrate 66 and the bottom substrate 60 are spaced apart by a predetermined distance and mounted together to form a complete triode device as shown in FIG. 6B. Such device of a triode structure utilizes the extrusive tips 610 of the silicon-containing layer 63 as field emitters. When a voltage difference is applied between a cathode electrode layer 61 and a gate electrode layer 65, electrons 69 are extracted from the cathode electrode layer 61 and accelerated toward the phosphor layer 68.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

I claim:

1. A method for fabricating field emitters, comprising:

(a) providing a substrate;

(b) forming a first conductive layer over said substrate;

(c) forming a silicon-containing layer over said first conductive layer, the silicon-containing layer including a doped amorphous layer or a doped polycrystalline layer;

(d) sequentially forming an insulative layer and a second conductive layer over said silicon-containing layer;

(e) patterning said second conductive layer and said insulative layer to expose portions of said silicon-containing layer; and (f) forming a plurality of extrusive tips extruded from the surface of said exposed silicon-containing layer by subjecting said exposed silicon-containing layer to an energy source.

2. The method as claimed in claim 1, wherein subjecting said exposed silicon-containing layer to said energy source includes subjecting said exposed silicon-containing layer to a laser beam.

3. The method as claimed in claim 2, wherein said laser beam selected from the group consisting of Nd:YAG laser, carbon dioxide (CO2) laser, argon (Ar) laser and excimer laser.

4. A method for fabricating field emitters, comprising:

(a) providing a substrate;

(b) forming a silicon-containing layer over said substrate, the silicon-containing layer including a doped amorphous layer or a doped polycrystalline layer;

(c) patterning said silicon-containing layer to form a plurality of silicon-containing islands; and (d) forming a plurality of extrusive tips extruded from the surface of said silicon-containing islands by subjecting said silicon-containing islands to an energy source.

5. The method as claimed in claim 4, further comprising between the steps (a) and (b), a step of forming a cathode electrode layer underlying said silicon-containing layer.

6. The method as claimed in claim 5, further comprising steps of:

(e) sequentially forming an insulative layer and a gate electrode layer over said substrate; and (f) patterning said insulative layer and said gate electrode layer to expose said plurality of extrusive tips.

7. The method as claimed in claim 4, wherein subjecting said silicon-containing islands to said energy source includes subjecting said silicon-containing islands to a laser beam.

8. The method as claimed in claim 7, wherein said laser beam is selected from the group consisting of Nd:YAG laser, carbon dioxide (CO2) laser, argon (Ar) laser and excimer laser.

* * * * *